US005579955A

United States Patent [19]

Sandou-Pascal et al.

[11] Patent Number: 5,579,955

[45] Date of Patent: Dec. 3, 1996

[54] PUSHBUTTON VALVE FOR DISPENSING A LIQUID IN SPRAY FORM, AND PRESSURIZED CONTAINER EQUIPPED WITH SUCH A VALVE

[75] Inventors: Corine Sandou-Pascal, Vanves; Jean-François Benoist, Paris, both of France

[73] Assignee: L'Oreal, Paris, France

[21] Appl. No.: 350,546

[22] Filed: Dec. 7, 1994

[30] Foreign Application Priority Data

Dec. 9, 1993 [FR] France ..... 93 14777

[51] Int. Cl.[6] ..... B65D 35/56

[52] U.S. Cl. ..... 222/105; 222/145.2; 222/145.5; 222/148; 222/402.18; 222/402.24

[58] Field of Search ..... 222/95, 105, 145.2, 222/145.5, 148, 402.18, 402.25

[56] References Cited

U.S. PATENT DOCUMENTS

| | | | |
|---|---|---|---|
| 3,283,962 | 11/1966 | Whitmore | 222/402.18 |
| 3,503,539 | 3/1970 | O'Donnell | 222/95 |
| 3,575,320 | 4/1971 | Prussin et al. | 222/402.18 X |
| 3,583,606 | 6/1971 | Ewald | 22/148 X |
| 3,674,180 | 7/1972 | Morane | 222/145.5 |
| 3,690,515 | 9/1972 | Ewald | 222/402.18 X |
| 3,710,984 | 1/1973 | Webster | 222/145 |
| 3,749,291 | 7/1973 | Prussin et al. | 222/402.24 |
| 4,030,644 | 6/1977 | Creighton | 222/402.24 X |
| 4,431,119 | 2/1984 | Stoody | 222/129 |
| 4,673,107 | 6/1987 | Obrist | 222/94 |
| 4,875,605 | 10/1989 | Weston | 222/402.18 X |

FOREIGN PATENT DOCUMENTS

| | | | |
|---|---|---|---|
| 305879 | 3/1973 | Australia . | |
| 0137897 | 4/1985 | European Pat. Off. . | |
| 2024210 | 8/1970 | France . | |
| 2415250 | 8/1979 | France . | |
| 1812718 | 9/1969 | Germany . | |
| 2333225 | 1/1974 | Germany | 222/402.24 |
| 1174119 | 12/1969 | United Kingdom . | |
| 1234964 | 6/1971 | United Kingdom . | |
| 1295166 | 11/1972 | United Kingdom . | |
| 2012885 | 8/1979 | United Kingdom . | |

*Primary Examiner*—Joseph Kaufman
*Attorney, Agent, or Firm*—Young & Thompson

[57] ABSTRACT

Pushbutton valve for dispensing, in the form of a spray, a liquid contained in a flexible pocket (2) which is located inside a container under pressure from a gas including a valve body (9) intended to be fixed into a dished part with the interposition of a sealing washer (13) between an open front end of the valve body and the dished part. A control stem (14) is able to slide between a position of rest and an open position. The valve body forms a chamber (C) which is isolated from the outside when the stem is at rest. The stem is held in this position of rest by a return spring. An additional gas inlet orifice (31) is provided in the lateral wall of the valve body, valve elements place the flexible pocket in communication with the chamber (C) when the stem (14) is pushed in, and isolate the pocket (2) from the chamber (C) when the valve is in the state of rest. These valve elements are controlled by the movement of the stem, and are able to establish the communication between the pocket (2) and the chamber (C) only after the control stem (14) has travelled a given distance (D).

6 Claims, 3 Drawing Sheets

PUSHBUTTON VALVE FOR DISPENSING A LIQUID IN SPRAY FORM, AND PRESSURIZED CONTAINER EQUIPPED WITH SUCH A VALVE

FIELD OF THE INVENTION

The invention relates to a pushbutton valve for dispensing, in the form of a spray, a liquid contained in a flexible pocket, which is located inside a container kept under pressure from a gas.

BACKGROUND OF THE INVENTION

The valve, which forms the subject of the invention, is of the sort of those which include a valve body intended to be fixed into a dished part, closing the container, with the interposition of a sealing washer between an open front end of the valve body and the dished part, and a control stem able to slide in the valve body between a position of rest and an open position. The valve body forms a chamber, which is isolated from the outside when the stem is at rest and interacts with the sealing washer so as to close the chamber. The stem is held in this position of rest by elastic return means. An additional gas inlet orifice is provided in the lateral wall of the valve body, which body is equipped, at its lower part, with a means for fastening the flexible pocket containing the liquid.

FR-A-2,415,250 shows a valve of this sort for dispensing, with mixing, two products contained respectively in a flexible pocket and in a container surrounding the pocket. The mixing of the products to be dispensed takes place in a chamber, which is located in a pushbutton surmounting the valve. The design is relatively complicated.

Moreover, U.S. Pat. No. 3,283,962 discloses a three-position valve for an aerosol container in which the liquid to be sprayed is directly in contact with the propellent gas, without being enclosed within a flexible pocket. A gas inlet orifice is provided in the wall of the chamber of the valve body; however, when the stem is in the dispensing position, this orifice is closed by a collar integral with the stem.

There has also been proposed, especially in DE-A-1,812,718, a valve for dispensing, in the form of a spray, a liquid contained in a flexible pocket the valve being as defined previously and one which, while making it possible to mix the liquid and the propellent gas in the chamber of the valve body, makes it possible to prevent pressurized gas from the container from entering the flexible pocket containing the liquid. The valve also prevents liquid from flowing out towards the container. The arrangement of such a valve offers the advantage of allowing the container equipped therewith to be used in all positions but, unfortunately, does not allow the chamber of the valve body to be purged each time, before and after a dose of a liquid/gas mixture is dispensed.

The object of the present invention is to propose a valve which does not exhibit these drawbacks.

SUMMARY OF THE INVENTION

According to the invention, a valve for dispensing, in the form of a spray, a liquid contained in a flexible pocket which is located inside a container kept under pressure from a gas, of the sort defined previously, includes valve means which place the flexible pocket in communication with the chamber when the stem is pushed in, and isolate the pocket from the said chamber when the valve is in the state of rest. These valve means are controlled by the movement of the stem, and are able to establish the communication between the pocket and the chamber only after the control stem has travelled a given distance, so that before and after a dose of a liquid/gas mixture is dispensed, the chamber is purged each time by a blast of gas alone.

According to a first embodiment, the valve stem, in a known manner, projects through an opening in the dished part and is capable of sliding in a sealed fashion in the sealing washer. This stem includes a blind bore opening at its end remote from the valve body. A transverse orifice is provided in the wall of the stem to emerge in the blind bore and, to the outside, in the region of the sealing washer when the stem is in the position of rest. The transverse orifice is then closed by this sealing washer. According the invention, the end of the stem situated in the valve body is equipped with an extension capable of interacting with a passage between the chamber of the valve body and the flexible pocket so that in the position of rest of the valve stem, the passage is closed by the extension, whereas when the valve stem is pushed in, a communication is set up between the chamber of the valve body and the flexible pocket.

The extension may consist of a pin, whereas a second sealing washer is provided in the bottom of the valve body. The above-mentioned passage is comprised of the central opening in the washer through which the pin passes in a sealed fashion. This pin includes a longitudinal passageway which communicates, at its lower end, with a transverse passageway emerging on the outer surface of the pin and, at its other end, with a passage provided in the valve stem and emerging in the chamber of the valve body. The exit of the lower transverse passageway is located in line with the second sealing washer and is closed by this washer when the stem is in the position of rest. The pin and the sealing washer constitute the valve means.

Preferably, the thickness of the second sealing washer is selected such that when the stem is pushed in with a view to open it, the orifice situated towards the lower end of the blind passageway in the stem enters into communication with the chamber of the valve body before the transverse passageway situated at the lower part of the pin enters into communication with a nozzle and the flexible pocket, which makes it possible to purge the chamber of the valve body in an intermediate pushed-in position of the valve stem.

Advantageously, the pin is pressed into a cavity provided at the end of the stem situated in the valve body.

According to an alternative embodiment, the passage for communication between the chamber of the valve body and the flexible pocket is provided in the valve body, whereas the extension of the valve stem includes an intermediate zone with a diameter which is smaller than that of the passage and an end zone with a sufficient diameter to close the passage. The unit is such that when the valve stem is pushed in, the intermediate zone finds itself in the region of the passage and establishes a communication between the flexible pocket and the chamber of the valve, whereas when the valve stem is in the position of rest, the end zone finds itself in the region of the passage and cuts off any communication.

The extension may consist of a coaxial cylindrical element fixed to the end of the valve stem, and whose end pointing towards the flexible pocket is equipped with an overmoulding made of an elastomeric material constituting the above-mentioned end zone.

According to another possibility, the extension and the valve stem form a single piece. The end zone of the extension may, advantageously, have the shape of a bell, with a relatively thin and flexible wall, the concavity of which points towards the flexible pocket.

According to another possibility, the valve means of the valve comprise a clack valve preventing any communication, at rest, between the pocket and the chamber of the valve body, this clack valve being made to open by the valve stem when it is pushed in.

The clack valve may be independent of the valve stem and rest against a seat formed by a second sealing washer under the action of a return spring. The seat is equipped with a central passage, and the clack valve is situated on the opposite side of the seat to the valve stem. The latter includes an extension finger capable of passing through the central passage and moves the clack valve away from its seat when the valve stem is pushed in. The travel of the stem required to open the clack valve is advantageously greater than that required to place the orifice of the blind bore of the valve stem in communication with the chamber situated inside the valve body.

The invention also relates to a container containing a flexible pocket, in which there is liquid to be sprayed, the pocket being kept under the pressure of a gas contained in the container, the latter being characterized in that it includes a dispensing valve as defined previously.

Apart from the provisions explained hereinabove, the invention consists in a certain number of other provisions which will be dealt with more fully hereafter with regard to exemplary embodiments described with reference to the appended drawings, but which are in no way limiting.

DETAILED DESCRIPTION OF THE INVENTION

Figure 1:
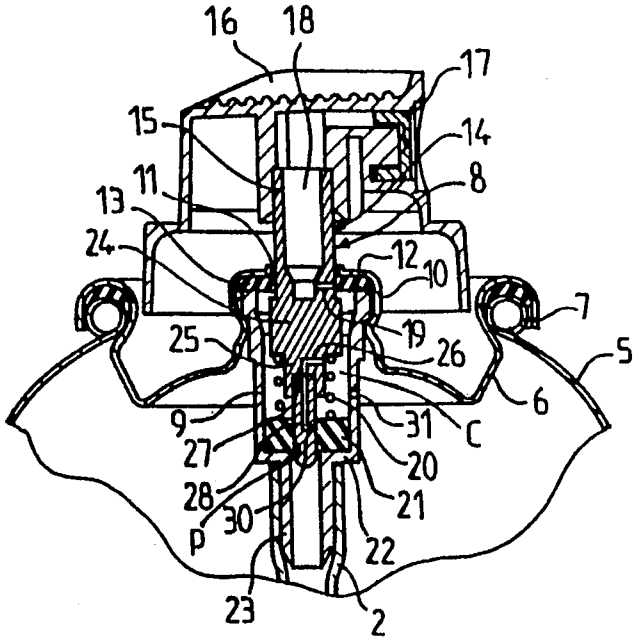
FIG. 1 of these drawings shows, in partial vertical section, a container under pressure from a gas, equipped with a valve according to the invention, in the position of rest, or closed position.

Referring to FIG. 1 of the drawings, it is possible to see the upper part of a container arranged in the form of a dome 5 including a central opening closed by a dished part 6 crimped onto the rolled edge 7 of the opening. The container has rigid walls, particularly ones made of metal, under pressure from a gas. Inside the container is located a flexible pocket 2 containing a liquid to be dispensed in the form of a spray. The container consists of a metal can of cylindrical shape, the bottom of which has a hole equipped with a valve allowing the container to be filled and refilled with a gas under pressure, particularly compressed air. The container may equally well be made of walls made of a hard thermoplastic and have any shape and be manufactured, for example, by extrusion blow-moulding or injection moulding.

A valve 8 is fastened into the dished part 6. This valve 8 includes a valve body 9 of cylindrical overall shape, around which is crimped a sort of sleeve 10 provided at the centre of the dished part, the upper end of the sleeve 10 including a central opening 11 provided in a cap 12 of the sleeve. A sealing washer 13 is interposed between the open front end of the valve body 9 and the internal surface of the cap 12 of the sleeve 10. The valve 8 may equally well be fastened by any other means, for example by screwing, snap-fitting or adhesive bonding using an intermediate piece.

Figure 2:
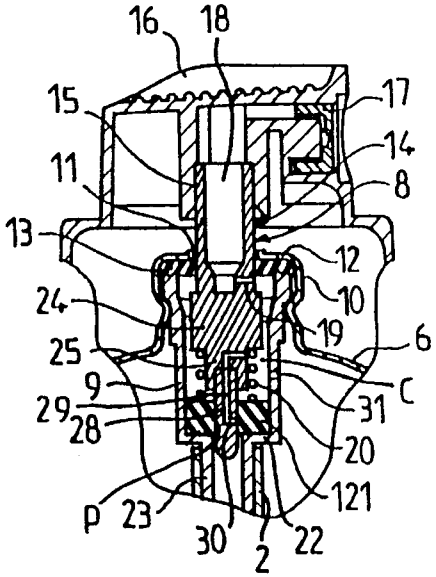
FIG. 2 shows the valve of FIG. 1 in an intermediate position for purging the chamber of the valve body.

The valve 8 also includes an operating stem 14 capable of sliding in the valve body 9 between a position of rest represented in FIG. 1 and an open position represented in FIG. 2.

The valve stem 14 projects through the opening 11 in the guise of a part 15 surmounted by a pushbutton 16, which includes passageways and a dispensing spray head 17.

The part 15 of the stem includes a blind bore 18 opening at its end remote from the valve body 9. A transverse orifice 19 is provided in the wall of the stem 14. This orifice 19 emerges in the blind bore 18 and, on the outside, in the region of the sealing washer 13 when the stem 14 is in the position of rest.

Elastic means formed of a coil-shaped compression spring 20 are provided between a limit stop zone of the valve body 9 and a limit stop zone of the stem 14 in order to keep this stem in the position of rest illustrated in FIG. 1. The spring 20 bears against a second sealing washer 21 which is applied against a shoulder 22 constituting the bottom of the body 9. The central opening in the washer 21 constitutes a passage p between the chamber C and the pocket 2. A nozzle 23 extends the body 9 towards the bottom 3 of the container. The flexible pocket 2 is engaged in a sealed fashion around this nozzle 23, which constitutes a means for fastening the said pocket. The nozzle 23 communicates with the internal chamber C of the body 9.

The valve stem 14 includes a base part 24 of a greater diameter than the part 15, situated inside the body 9. This base part 24 has a diameter which is smaller than the internal diameter of the body 9 so that there is sufficient radial clearance between the cylindrical outline of this base part 24 and the internal surface of the body 9 for the passage of the gas and liquid to be sprayed. The end 25, situated in the valve body 9, of the stem 14 is arranged in the form of a cylindrical projection of diameter smaller than the base part 24, and around which one end of the spring 20 is engaged.

This end 25 includes an elbowed passage 26 emerging, at one end, in its external surface and, at its other end, substantially in the axial direction, in a cavity 27 provided in the bottom of the projection 25 and open towards the nozzle 23.

The end 25 of the stem 14 is equipped with a coaxial pin 28 for extending it in the direction of the nozzle 23. The pin 28 passes in a sealed fashion through the central passage p of the washer 21 when the valve is at rest (FIG. 1). The pin 28 includes a longitudinal passageway 29 emerging axially at its upper end so as to communicate with the passageway 26. The passageway 29 does not emerge axially at its lower end but communicates with a transverse passageway 30 emerging on the outside surface of the pin. The pin 28 can be pressed forcibly into the cavity 27. The fastening of the pin 28 to the stem 14 may be supplemented by welding or adhesive bonding.

The unit is such that when the stem 14 is in the position of rest, for example when the shoulder formed by the base part 24 is bearing against the sealing washer 13, the transverse passageway 30 is in line with the sealing washer 21, and is therefore closed.

The pin 28 and the sealing washer 21 form valve means.

An orifice 31 constituting an additional gas inlet is provided in the lateral wall of the body 9.

The unit is furthermore designed so that when the stem 14 is pushed in under the effect of pressure exerted on the button 16, the transverse orifice 19 escapes the washer 13 and emerges in the chamber C bounded by the body 9 before the transverse passageway 30 opens into the nozzle 23.

It can be seen that in the position of rest of the stem 14, as illustrated in FIG. 1, any communication between the flexible pocket 2 and the container is cut. Under these conditions, if the container is held head up, as illustrated in FIG. 1, the pressurized gas from the container which penetrates the valve body 9 through the orifice 31 cannot enter the flexible pocket 2.

If the container is inverted into a head-down position, the liquid from the pocket 2 cannot leave the pocket or spread itself out in the chamber C of the valve body and pass through the orifice 31 into the container.

In order to dispense the liquid contained in the pocket 2, in the form of a spray, it is sufficient to press, in the conventional manner, on the button 16, the container being, for example, held head up. When the stem 14 is pushed in sufficiently, the transverse orifice 19 communicates with the chamber C of the valve body, whereas the transverse passageway 30 opens into the nozzle 23. Liquid from the pocket 2 can pass through the passageways 30, 29 and 26 to arrive in the chamber C which constitutes a chamber for mixing between the liquid and the gas which arrives through the orifice 31. The mixture thus formed escapes through the orifice 19 towards the spray head 17 and is sprayed into the atmosphere.

Due to the fact that the liquid contained in the pocket 2 is isolated from the gas in the container, the latter can be used in any position, and not only head-up as indicated hereinabove. In particular, if the container is used head down, the fact that in the position of rest the liquid from the pocket 2 cannot pass into the container makes it possible to avoid spraying a jet of liquid at the spray head 17, instead of a mist. Furthermore, it is possible when spraying to change from one position to the other, particularly passing through the horizontal, and to guarantee a constant spray quality.

The thickness of the sealing washer 21 is chosen so that during some of the travel for pushing in the stem 14, the transverse passageway 30 remains closed off by the washer 21 while the transverse orifice 19 communicates with the chamber C. Under these conditions, during this intermediate phase illustrated by FIG. 2, gas under pressure coming from the container and passing through the orifice 31 can escape through the transverse orifice 19, purging the chamber C.

Figure 3:
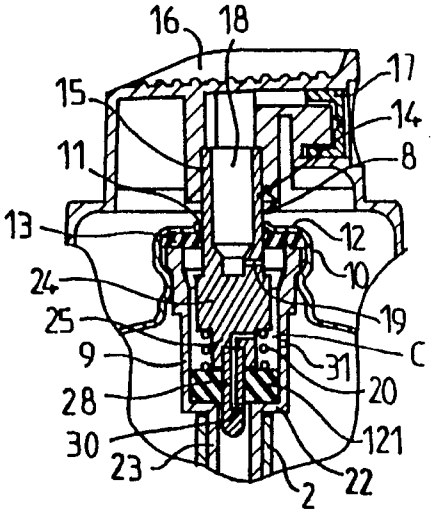
FIG. 3 shows the valve of FIG. 1 in the open position.

When the stem 14 is pushed in sufficiently to reach the position illustrated in FIG. 3, the transverse passageway 30 then emerges into the nozzle 23 and allows the liquid contained in the pocket 2 to flow out into the chamber C to be entrained by the propellent gas and be sprayed through the spray head 17.

Thus, the thickness of the washer 21, combined with the judicious arrangement of the various passageways and dimensions of the elements, makes it possible to obtain a sequence of the respective opening of the orifices with a purge effect for a position (FIG. 2) which is intermediate between the closed position (FIG. 1) and the completely open position (FIG. 3).

As can be seen, this arrangement makes it possible each time to purge the chamber C before and after a dose of a liquid/gas mixture is dispensed.

Figure 4:
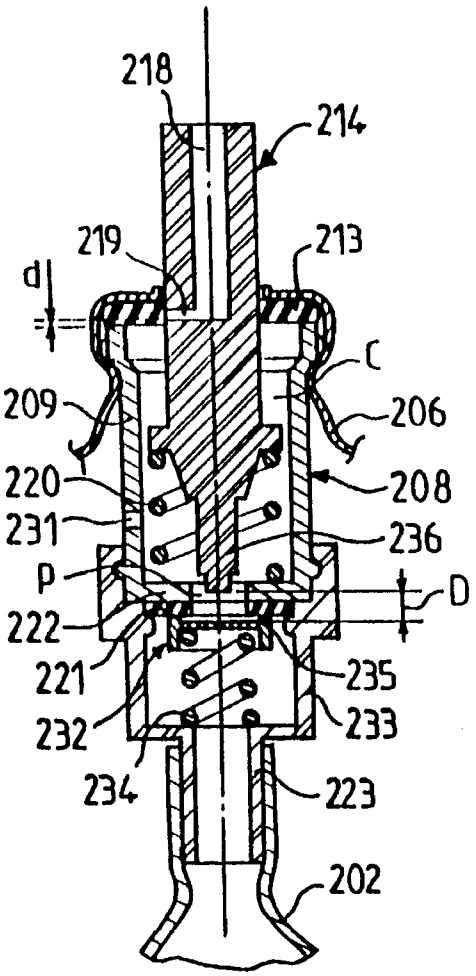
FIG. 4 illustrates an alternative embodiment of the valve with a clack valve independent of the stem.

FIG. 4 illustrates an alternative embodiment of the valve 208, in which the valve means of the flexible pocket 202 and of the nozzle 223 comprise a clack valve 232 preventing any communication at rest between the pocket 202 and the chamber C of the valve body 209.

The clack valve 232 is made to open via the stem 214 when it is pushed in.

The various elements of the valve of FIG. 4 which are identical or play similar parts to the elements already described with relation to FIGS. 1 to 3 are denoted by numerical references whose ten and unit figures are identical, but which are preceded by the numeral 2 in the hundreds. They will not be described again or will be described only briefly.

The nozzle 223 is provided under an adaptor 233 attached in a sealed fashion, for example by snap-fitting, to the lower end of the valve body 209. The shoulder 222 constituting the bottom of the body 209 has a flat face on the opposite side from the chamber C. The second sealing washer 221 is located against the lower face of the shoulder 222. The clack valve 232 is situated in the adaptor 233. A compression spring 234, bearing at one end against a wall of the adaptor 233, applies the clack valve 232 in a sealed fashion against the washer 221. The clack valve 232 consists of a sort of disc of which the peripheral edge has a circular ridge 235 coming to bear against the washer 221. A central passage p is defined by orifices provided in the bottom of the body 209 and in the washer 221, which orifices are superimposed.

The valve stem 214 is extended, towards the disc forming the clack valve 232, by a finger 236 of sufficiently small diameter to pass, with sufficient clearance, through the passage p.

In the position of rest illustrated in FIG. 4, obtained when the spring 220 is relaxed, the transverse orifice 219 is closed by the first sealing washer 213.

Preferably, the distance d between the lower edge of the orifice 219 and the lower face of the washer 213 is smaller than the distance D between the lower end of the finger 236 and the disc of the clack valve 232 in the closed position ($d<D$). Under these conditions, when the stem 214 is pushed in, an intermediate purging phase is provided as explained before.

The operation of the valve of FIG. 4 stems immediately from the preceding explanations.

When the stem 214 is in the position of rest illustrated in FIG. 4, the clack valve 232 closes the passage p and cuts any communication between the pocket 202 and the chamber C, which is in communication via the orifice 231 with the container containing the pressurized gas. Regardless of the position of the container, the pressurized gas cannot penetrate the pocket 202 and, conversely, liquid from the pocket 202 cannot flow towards the chamber C or, through the orifice 231, into the container containing the gas.

When the stem 214 is pushed in, the orifice 219 is firstly uncovered, which allows gas out, purging the chamber C. With the stem 214 continuing to be pushed in, the lower end of the finger 236 comes into contact with the clack valve 232 and moves it away from the sealing washer 221.

The liquid from the pocket 202 can then pass into the chamber C, mix with the gas to form a mist which escapes through the orifice 219 and the passageway 218 for the purpose of spraying it.

As can be seen, this arrangement allows the chamber C to be purged each time before and after a dose of a liquid/gas mixture is dispensed.

Figure 5:
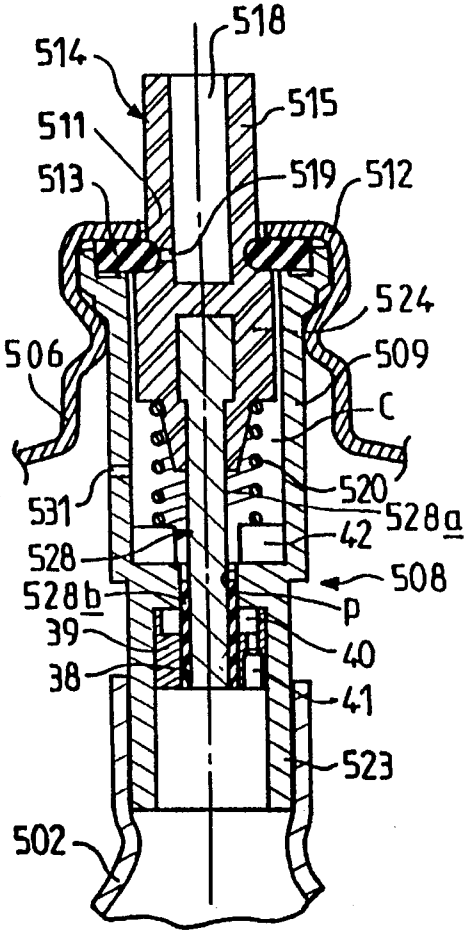
FIG. 5 shows, in axial section, an alternative of the valve of FIGS. 1 to 3, in the closed position or position of rest.

Referring to FIG. 5, it is possible to see an alternative embodiment of the valve of FIGS. 1 to 3 in the closed position or position of rest. Elements which are identical or fulfil similar roles to elements already described with regard to FIGS. 1 to 3 are denoted by numerical references which have the same numerals in the units and tens, but which are preceded by the numeral 5 in the hundreds. The description of these elements will not be repeated, or will be given only briefly.

The extension 528 of the valve stem 514 consists of a coaxial cylindrical element fixed to the end of the valve stem 514. This extension 528 may be made of a rigid material, and its end pointing towards the flexible pocket is equipped with an overmoulding 38 made of an elastomeric material enveloping the end of the extension 528 over a certain axial distance. The lower part 523 of the valve body 509 is arranged in the form of a cylindrical sleeve with a diameter slightly smaller than that of the valve body, and to which the flexible pocket 502 is fastened. Communication between the chamber C of the valve body 509 and the bore of the part 523 which communicates with the flexible pocket is provided by the coaxial cylindrical passage p defined by a restriction marking the separation between the chamber C and the part 523.

The axial length of the overmoulding 38 is sufficient for this overmoulding 38 to be engaged, at least in part, in the passage p in the position of rest of the valve illustrated in FIG. 5. The diameter of the overmoulding 38 is sufficient to close this passage p in a sealed fashion.

The stem 528 thus has an intermediate zone **528*a* with a diameter smaller than that of the passage p, and an end zone 528*b* corresponding to the overmoulding 38** having sufficient diameter to close the passage p.

Sliding guidance of the extension 528 is supplemented by a sleeve 39 forcibly engaged in the bore of the part 523 and coming into abutment against the shoulder marking the bottom of this bore. The wall of the sleeve 39, pointing towards the passage p, includes an annular cavity 40 into which there emerges a cylindrical passageway 41 which is radially offset relative to the axis of the sleeve, and causes the cavity 40 to communicate with the flexible pocket 502. The diameter of the bore of the sleeve 39 is equal to the diameter of the passage p or slightly greater than this diameter.

The chamber C is equipped, at its lower part, with radial ribs 42, for example numbering four offset by 90°, against which the lower end of the spring 520 bears.

The operation of the valve of FIG. 5 is similar to that described with regard to FIGS. 1 to 3.

When the valve stem 514 is pushed in, the orifice 519 is freed from the sealing washer 513 and enters into communication with the chamber C this, firstly, allowing this chamber to be purged by the pressurized gas which can pass through the orifice 531. The overmoulding 38 remains engaged, in part, in the passage p and prevents any communication between the pocket 502 and the chamber C.

Continuing to push in the stem 514 causes the overmoulding 38 to come out of the passage p downwards, which establishes communication between the chamber C and the cavity 40, itself in communication with the pocket 502 via the passageway 41. The product contained in the pocket 502 is then dispensed as explained before.

As can be seen, this arrangement allows the chamber C to be purged each time before and after a dose of a liquid/gas mixture is dispensed.

Figure 6:
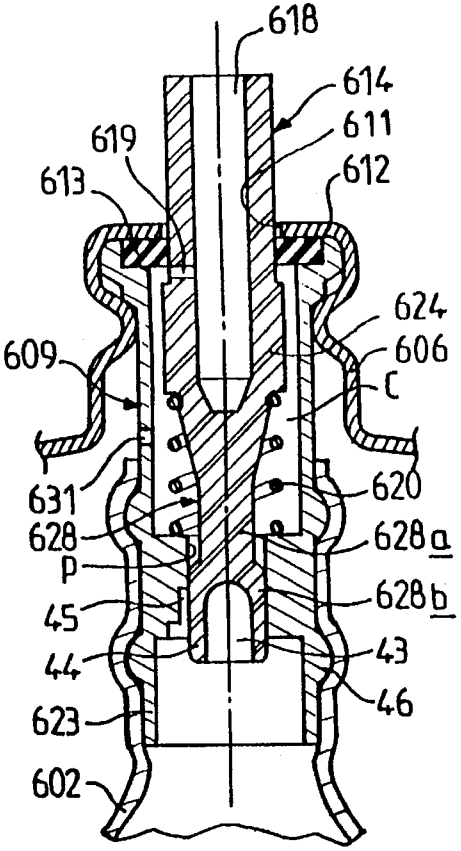
FIG. 6 shows, in axial section, another alternative of the valve of FIGS. 1 to 3, at the beginning of opening.
Figure 7:
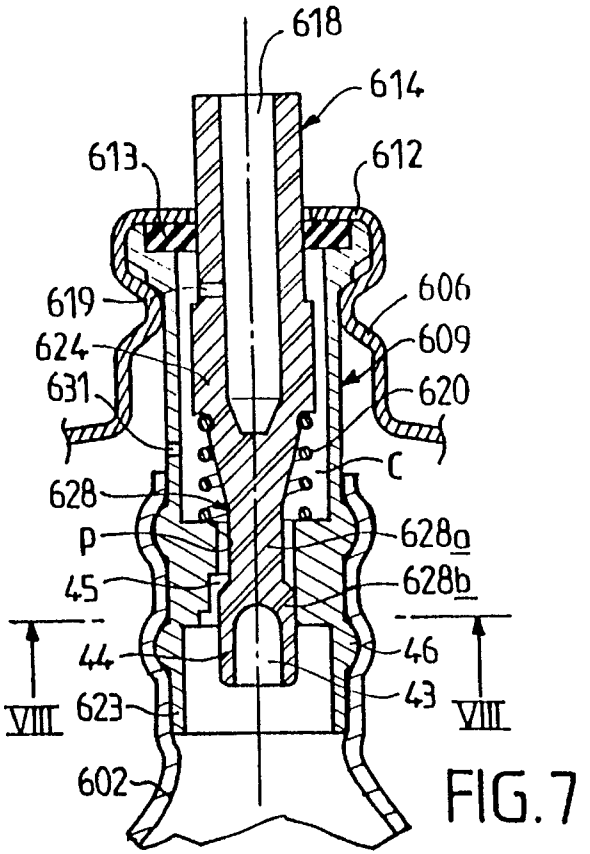
FIG. 7 shows, in axial section, the valve of FIG. 6 in the completely open position.
Figure 8:
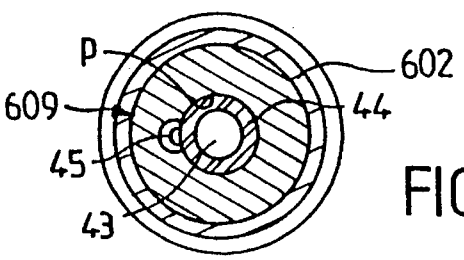
FIG. 8 is a section on VIII—VIII of FIG. 7.

Referring to FIGS. 6 to 8, it is possible to see an alternative embodiment of the valve of FIG. 5. The elements fulfilling roles identical to elements already described with regard to this FIG. 5 are denoted by numerical references whose numerals in the units and tens are identical, but whose numeral in the hundreds is equal to 6.

In this alternative, the extension 628 forms a single piece with the valve stem 614. The intermediate zone **628*a* of this extension has a diameter smaller than that of the passage p. This zone 628*a* is connected to the valve stem via a frustoconical part and, on the opposite side, to the end zone 628*b* with sufficient diameter to close the passage p. This end zone 628*b* is arranged substantially in the shape of a bell, with a concavity 43 pointing towards the flexible pocket 602. The wall 44 bounding the concavity 43 is relatively thin and flexible so that it can deform elastically under the effect of the pressure in the flexible pocket so that it is applied in a sealed fashion against the wall of the passage p. This passage p includes, on the side pointing towards the flexible pocket 602, a partially cylindrical cutaway 45 making it possible to establish communication between the chamber C and the pocket 602 when the stem 614 is pushed in sufficiently, as illustrated in FIG. 7**.

The lower part 623 of the valve body 609 has the same outside diameter as this valve body. It includes one or more external peripheral beads 46 facilitating the sealed fastening of the flexible pocket.

The operation of the valve of FIGS. 6 to 8 is similar to that described with regard to FIGS. 1 to 3, and to FIG. 5.

In the position of rest or closed position (not represented), the orifice 619 is in line with the washer 613 and is closed in a sealed fashion by this washer whereas the end **628*b*** closes the passage p.

As the valve stem 614 starts to be pushed in, as illustrated in FIG. 6, the orifice 619 communicates with the chamber C, which allows purging before the end **628*b* uncovers the cutaway 45**.

When the stem 614 continues to be pushed in, as illustrated in FIG. 7, the cutaway 45 is Uncovered by the end **628*b* and a communication is established, via this cutaway 45 and the annular space bounded between the wall of the passage p and the wall of the zone 628*a*, between the chamber C and the flexible pocket 602. The product from the pocket 602** is therefore dispensed.

As can be seen, this arrangement allows the chamber C to be purged each time before and after a dose of a liquid/gas mixture is dispensed.

We claim:

1. Pushbutton valve for dispensing, in the form of a spray, a liquid contained in a flexible pocket which is located inside a container under pressure from a gas, said valve being constructed and arranged so that it is operational regardless of the position of the container, and including a valve body intended to be fixed into a dished part with the interposition of a sealing washer between an open front end of the valve body and the dished part, a control stem having a first end and a second end, and adapted to slide in the valve body between a position of rest and an open position, said valve body forming an isolated chamber when the stem is at rest and interacts with the sealing washer to as to close said chamber, said stem being held in said position of rest by elastic return means, an additional gas inlet orifice provided in a lateral wall of the valve body, said body being equipped, at its lower part, with means for fastening the flexible pocket containing the liquid, valve means adapted to place the flexible pocket in communication with the chamber when the stem is pushed in, and to isolate the pocket from the chamber when the valve is in a state of rest, said valve means being controlled by the movement of the stem and establishing the communication between the pocket and the chamber only after the stem has travelled a given distance, so that before and after a dose of a liquid/gas mixture is dispensed, the chamber is purged each time by a blast of gas alone, said stem projecting through an opening in the dished part and adapted to slide in a sealed fashion in the sealing washer, said stem including a blind bore opening at the first end remote from the valve body, a transverse orifice being provided in a wall of the stem and emerging in the blind bore and in the region of the sealing washer when the stem is in the position of rest, said transverse orifice being closed by the sealing washer, the second end of the stem situated in the valve body being equipped with an extension capable of interacting with a passage between the chamber of the valve body and the flexible pocket so that in the position of rest of the stem, the passage is closed by the extension, whereas when the stem is pushed in, a communication is established between the chamber of the valve body and the flexible pocket, said passage being provided in the valve body, said extension including an intermediate cylindrical zone having a diameter which is smaller than that of the passage and an end zone with a sufficient diameter to close the passage, wherein when the stem is pushed in, the intermediate cylindrical zone finds itself in the region of the passage and establishes a communication between the flexible pocket and the chamber, whereas when the stem is in the position of rest, the end zone finds itself in the region of the passage and cuts any communication.

2. Valve according to claim 1, wherein the extension comprises a coaxial cylindrical element fixed to the second end of the stem, and said end zone comprises an overmoulding made of an elastomeric material.

3. Valve according to claim 2, further including a sleeve forcibly engaged in a bore of the fastening means and coming into abutment against a shoulder delimiting the bottom of the bore and serving to slidingly guide the extension, said sleeve including an annular cavity into which emerges a cylindrical passage radially offset with respect to an axis of the Sleeve and providing communication between the cavity and the flexible pocket.

4. Valve according to claim 2, wherein the chamber is equipped at its lower part with radial ribs, and said return means have a lower end which bears against said ribs.

5. Container comprising a flexible pocket containing a liquid to be sprayed, said pocket being kept under the pressure of a gas contained in the container, said container including a pushbutton valve for dispensing a spray of the liquid, said valve being constructed and arranged so that it is operational regardless of the position of the container, and including a valve body intended to be fixed into a dished part with the interposition of a sealing washer between an open front end of the valve body and the dished part, a control stem having a first end and a second end, and adapted to slide in the valve body between a position of rest and an open position, said valve body forming an isolated chamber when the stem is at rest and interacts with the sealing washer to as to close said chamber, said stem being held in said position of rest by elastic return means, an additional gas inlet orifice provided in a lateral wall of the valve body, said body being equipped, at its lower part, with means for fastening the flexible pocket containing the liquid, valve means adapted to place the flexible pocket in communication with the chamber when the stem is pushed in, and to isolate the pocket from the chamber when the valve is in a state of rest, said valve means being controlled by the movement of the stem and establishing the communication between the pocket and the chamber only after the stem has travelled a given distance, so that before and after a dose of a liquid/gas mixture is dispensed, the chamber is purged each time by a blast of gas alone, said stem projecting through an opening in the dished part and adapted to slide in a sealed fashion in the sealing washer, said stem including a blind bore opening at the first end remote from the valve body, a transverse orifice being provided in a wall of the stem and emerging in the blind bore and in the region of the sealing washer when the stem is in the position of rest, said transverse orifice being closed by the sealing washer, the second end of the stem situated in the valve body being equipped with an extension capable of interacting with a passage between the chamber of the valve body and the flexible pocket so that in the position of rest of the stem, the passage is closed by the extension, whereas when the stem is pushed in, a communication is established between the chamber of the valve body and the flexible pocket, said passage being provided in the valve body, said extension including an intermediate cylindrical zone having a diameter which is smaller than that of the passage and an end zone with a sufficient diameter to close the passage, wherein when the stem is pushed in, the intermediate cylindrical zone finds itself in the region of the passage and establishes a communication between the flexible pocket and the chamber, whereas when the stem is in the position of rest, the end zone finds itself in the region of the passage and cuts any communication.

6. Container according to claim 5, wherein the container bottom includes a hole equipped with a valve for filling and refilling said container with a gas under pressure.

* * * * *